US005388886A

United States Patent [19]

LaPointe et al.

[11] Patent Number: 5,388,886

[45] Date of Patent: Feb. 14, 1995

[54] DUAL LEG REST ASSEMBLY

[75] Inventors: Larry P. LaPointe, Temperance; Jonathan R. Saul, LaSalle; Karl J. Komorowski, Petersburg, all of Mich.

[73] Assignee: La-Z-Boy Chair Co.

[21] Appl. No.: 100,915

[22] Filed: Aug. 9, 1993

[51] Int. Cl.[6] ..... A47C 1/02

[52] U.S. Cl. ..... 297/75; 297/85

[58] Field of Search ..... 297/75, 76, 85, 68, 297/89, 423.35, 423.34

[56] References Cited

U.S. PATENT DOCUMENTS

| | | | |
|---|---|---|---|
| 27,645 | 5/1860 | McGregor . | |
| 76,577 | 4/1868 | Zinn . | |
| 78,304 | 5/1868 | Martin . | |
| 248,752 | 10/1881 | Huston . | |
| 390,363 | 10/1888 | Ecker et al. . | |
| 1,248,931 | 12/1917 | Schuman . | |
| 1,626,069 | 4/1927 | Beech . | |
| 2,630,162 | 3/1953 | Rechler . | |
| 2,664,942 | 1/1954 | Spear . | |
| 2,774,412 | 12/1956 | Luckhardt . | |
| 3,103,381 | 9/1963 | Schliephacke . | |
| 3,244,449 | 4/1966 | Re . | |
| 3,494,660 | 2/1970 | Caldemeyer et al. . | |
| 3,537,747 | 11/1970 | Rogers . | |
| 3,550,952 | 12/1971 | Ferguson . | |
| 3,652,125 | 3/1972 | Rogers, Jr. . | |
| 3,790,211 | 2/1974 | Caldwell . | |
| 3,865,432 | 2/1975 | Rogers, Jr. . | |
| 3,874,724 | 4/1975 | Re . | |
| 3,904,240 | 9/1975 | Rogers, Jr. et al. . | |
| 4,357,049 | 11/1982 | Rogers, Jr. et al. | 297/85 X |
| 4,367,895 | 1/1983 | Pacitti et al. . | |
| 4,410,213 | 10/1983 | Samson . | |
| 4,519,647 | 5/1985 | Rogers, Jr. | 297/85 |
| 4,570,996 | 2/1986 | Rogers, Jr. . | |
| 4,669,778 | 6/1987 | Rogers, Jr. . | |
| 4,674,794 | 6/1987 | Pine . | |
| 4,790,599 | 12/1988 | Goldman . | |
| 4,915,444 | 4/1990 | Rogers, Jr. . | |
| 4,989,914 | 2/1991 | Pine | 297/85 |
| 5,090,768 | 2/1992 | Re et al. | 297/75 X |
| 5,156,441 | 10/1992 | Byersmith et al. | 297/75 X |

FOREIGN PATENT DOCUMENTS

| | | |
|---|---|---|
| 39568 | 11/1931 | France . |
| 3524056 | 1/1987 | Germany . |
| 73511 | 1/1986 | Taiwan, Prov. of China . |
| 878022 | 9/1961 | United Kingdom . |
| 2085292 | 5/1985 | United Kingdom . |

*Primary Examiner*—Laurie K. Cranmer
*Attorney, Agent, or Firm*—Harness, Dickey & Pierce

[57] ABSTRACT

An improved dual leg rest assembly is disclosed which is adapted for use in single and multi-person articles of furniture (i.e., chairs, sectionals, sofas, loveseats, etc.). More particularly, an improved linkage mechanism is provided for causing coordinated articulating movement of a primary leg rest panel and a secondary leg rest panel (i.e., mid-ottoman).

8 Claims, 4 Drawing Sheets

DUAL LEG REST ASSEMBLY

BACKGROUND OF THE INVENTION

The present invention relates generally to articles of furniture of the type having an extensible leg rest assembly and, in particular, to a dual leg rest assembly having a primary leg rest panel and a secondary leg rest panel interconnected by a linkage mechanism for concurrent articulated movement between stowed and extended positions.

Traditionally, reclining-type articles of furniture (i.e., chairs, sofas, loveseats, sectionals, etc.) are equipped with an actuation mechanism for operatively interconnecting a seat assembly to a stationary frame structure for reclining movement between an "upright" position and various "reclined" positions. As an additional comfort feature, the actuation mechanism may also be adapted to move an extensible leg rest assembly between a retracted (i.e., "stowed") position and a protracted (i.e., "extended") position. The actuation mechanism typically includes a combination of various mechanical linkages that can be selectively actuated for causing either coordinated or independent reclining movement of the seat assembly relative to extensible movement of the leg rest assembly.

As is known, most conventional leg rest assemblies include an upholstered leg rest panel and a pair of scissor-type linkages interconnecting the leg rest panel to the actuation mechanism for movement between the stowed and extended positions. In the extended position, a gap is created between a front edge of the seat and a rear edge of the leg rest panel such that only the seat occupant's feet and lower legs are supported on the leg rest panel. In an effort to provide additional leg support, it has been proposed to incorporate a second leg rest panel (i.e., a mid-ottoman) into the leg rest assembly between the seat and the primary leg rest panel to provide a substantially uninterrupted leg support surface. In essence, such a "dual"leg rest assembly is operable for converting the reclining chair into a chaise lounge chair. Various examples of reclining chairs equipped with a dual leg rest assembly are disclosed in U.S. Pat. Nos. 2,774,412 (Luckhardt); 2,871,917 (Schliephacke); 2,914,114 (Fletcher); 3,537,747 (Rodgers); 4,674,794 (Pine); and 5,090,768 (Re). However, most conventional dual leg rest assemblies have a linkage mechanism that is relatively complex, bulky, and expensive to manufacture. Commonly, this complexity is due to the need to provide and maintain adequate clearance between the two leg panels during the concurrent articulated movement therebetween. In addition, some conventional dual leg rest assemblies require the secondary leg rest panel to be thinner than the primary leg rest panel to again maintain adequate clearance therebetween during articulated movement.

Thus, while some conventional dual leg rest assemblies operate satisfactorily for their intended purpose, furniture manufacturers are continually striving to develop an improved linkage mechanism for reduced complexity, increased structural soundness and smoother operation as well as for enhanced occupant comfort and convenience. Furthermore, there is a continuing desire to develop an improved linkage mechanism which reduces fabrication and assembly costs while promoting enhanced product quality.

SUMMARY OF THE INVENTION

Accordingly, the present invention is generally directed to providing an improved "dual" leg rest assembly for use in articles of furniture. Therefore, a primary object of the present invention is to provide an improved linkage mechanism for a dual leg rest assembly which reduces its overall complexity and cost while providing smooth operation and enhanced comfort to the seat occupant.

It is another object of the present invention to provide a linkage mechanism for a dual leg rest assembly that can be installed into articles of furniture without requiring significant modification of the article and, in essence, in substitution for a traditional leg rest assembly.

In a preferred embodiment of the present invention, a reclining chair is equipped with a dual leg rest assembly having a primary leg rest panel and a secondary leg rest panel interconnected by a unique linkage mechanism for concurrent articulated movement between "stowed" and "extended" positions.

Various other objects, features and advantages of the present invention will become apparent to one skilled in the art from studying the following written description, taken in conjunction with the accompanying drawings and appended claims.

DETAILED DESCRIPTION OF THE INVENTION

In accordance with the teachings of the present invention, an improved "dual" leg rest assembly is disclosed which is adapted for use in single and multi-person articles of furniture (i.e., chairs sectionals, sofas, loveseats, etc.). More particularly, an improved linkage mechanism is disclosed that is operable for causing coordinated articulating movement of a primary leg rest panel and a secondary leg rest panel (i.e., mid-ottoman). Moreover, while the particular embodiment disclosed teaches of manually actuating the improved linkage mechanism via a well-known handle-type actuation mechanism, it will be understood, however, that the principles of the present invention apply equally to other actuation systems known to those skilled in the art. For example, the linkage mechanism of the present invention can alternatively be actuated in response to reclining movement of the seat assembly or via a motor driven actuation system. In addition, it will be appreciated that the novel dual leg rest assembly of the present invention is universally applicable for incorporation and use with virtually any reclining-type article of furniture for converting it into a chaise lounge-type seating arrangement. Finally, since the particular form of the article of furniture does not per se comprise part of the invention, only those portions or components thereof necessary for a clear understanding of the invention will be described with any specificity.

Figure 1:
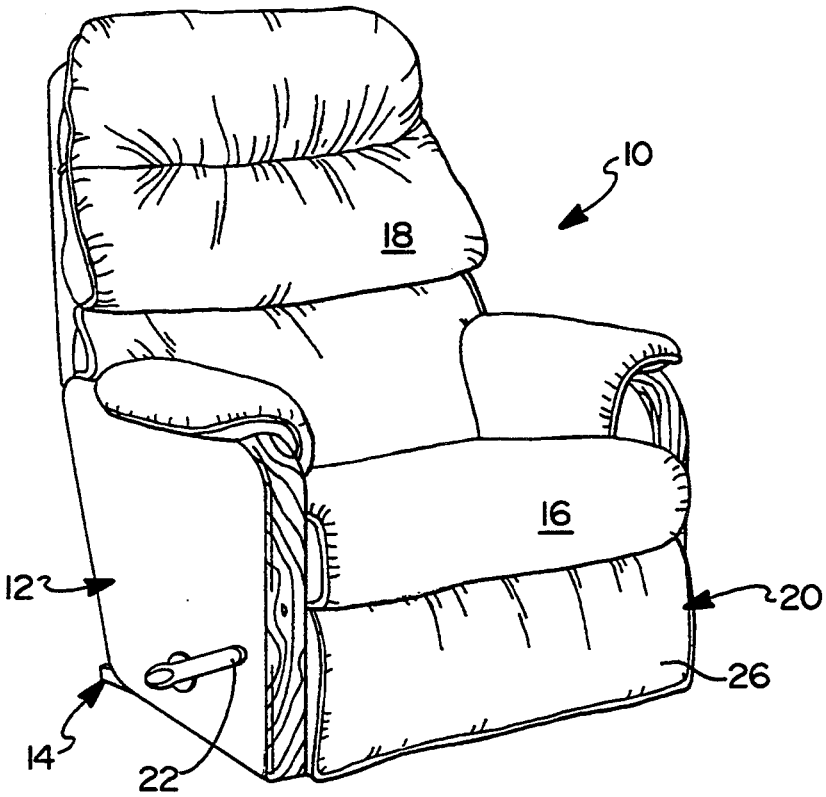
FIG. 1 is a perspective view of an exemplary reclining chair having the dual leg rest assembly of the present invention shown in a fully retracted or "stowed" position.
Figure 2:
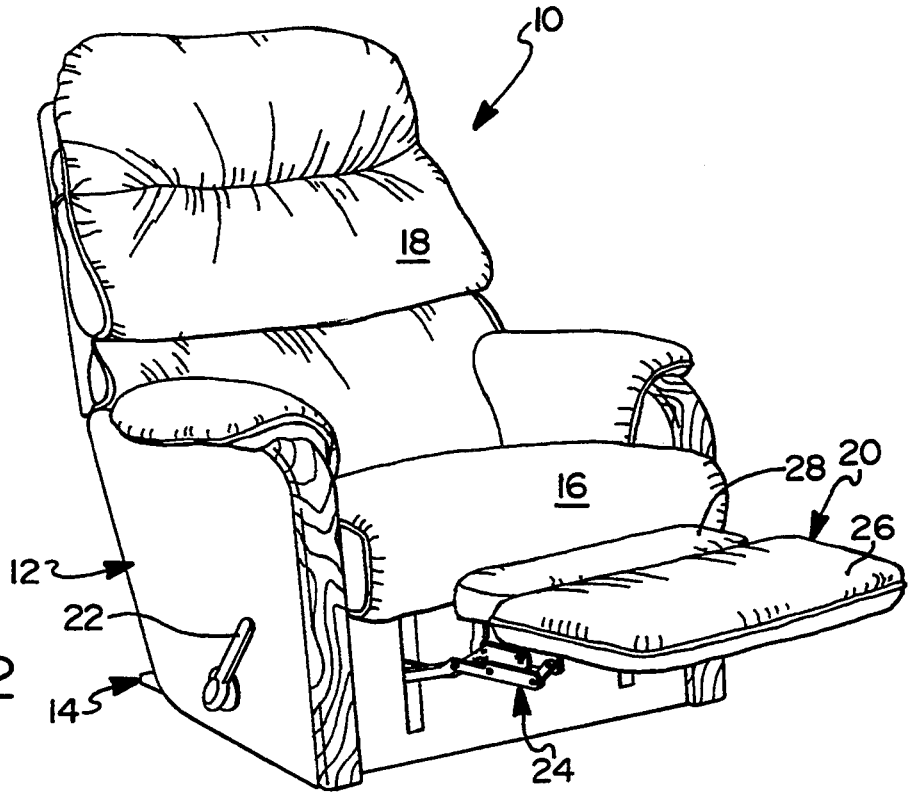
FIG. 2 is another perspective view of the reclining chair showing the dual leg rest assembly protracted to a fully "extended" position.

With reference to the drawings, and particularly FIGS. 1 and 2, an exemplary rocker/recliner chair 10 is shown to include an upholstered chair frame 12 that is supported for rocking movement from a stationary platform-type base assembly 14. A cushioned seat member 16 and a cushioned seatback member 18 are supported from chair frame 12 and define a seat assembly. The seat assembly is supported on chair frame 12 via any suitable reclining mechanism for permitting reclining movement thereof between an "upright" position and a fully "reclined" position. Chair 10 is also shown to include an extensible leg rest assembly 20 that can be moved between a "stowed" position (FIG. 1) and a fully "extended" position (FIG. 2) in response to manual actuation of a suitable actuation mechanism, such as by rotation of a handle 22. As will be detailed, angular rotation of handle 22 is adapted to cause an actuation mechanism, such as a drive rod 23, to urge a pair of linkage mechanisms 24 to move synchronously between retracted and protracted positions for causing the concurrent articulated movement of a primary leg rest panel 26 and a secondary leg rest panel 28 between their stowed and extended positions, respectively. In the stowed position, secondary leg rest panel 28 is maintained in a position behind and generally parallel to primary leg rest panel 26 so as to be concealed from view. However, when handle 22 is rotated to synchronously drive linkage mechanisms 24 toward their protracted state, secondary leg rest panel 28 folds out or "pops up" to establish a generally continuous and uninterrupted leg support surface between a front edge of seat cushion 16 and a rear edge of primary leg rest panel 26.

Figure 3:
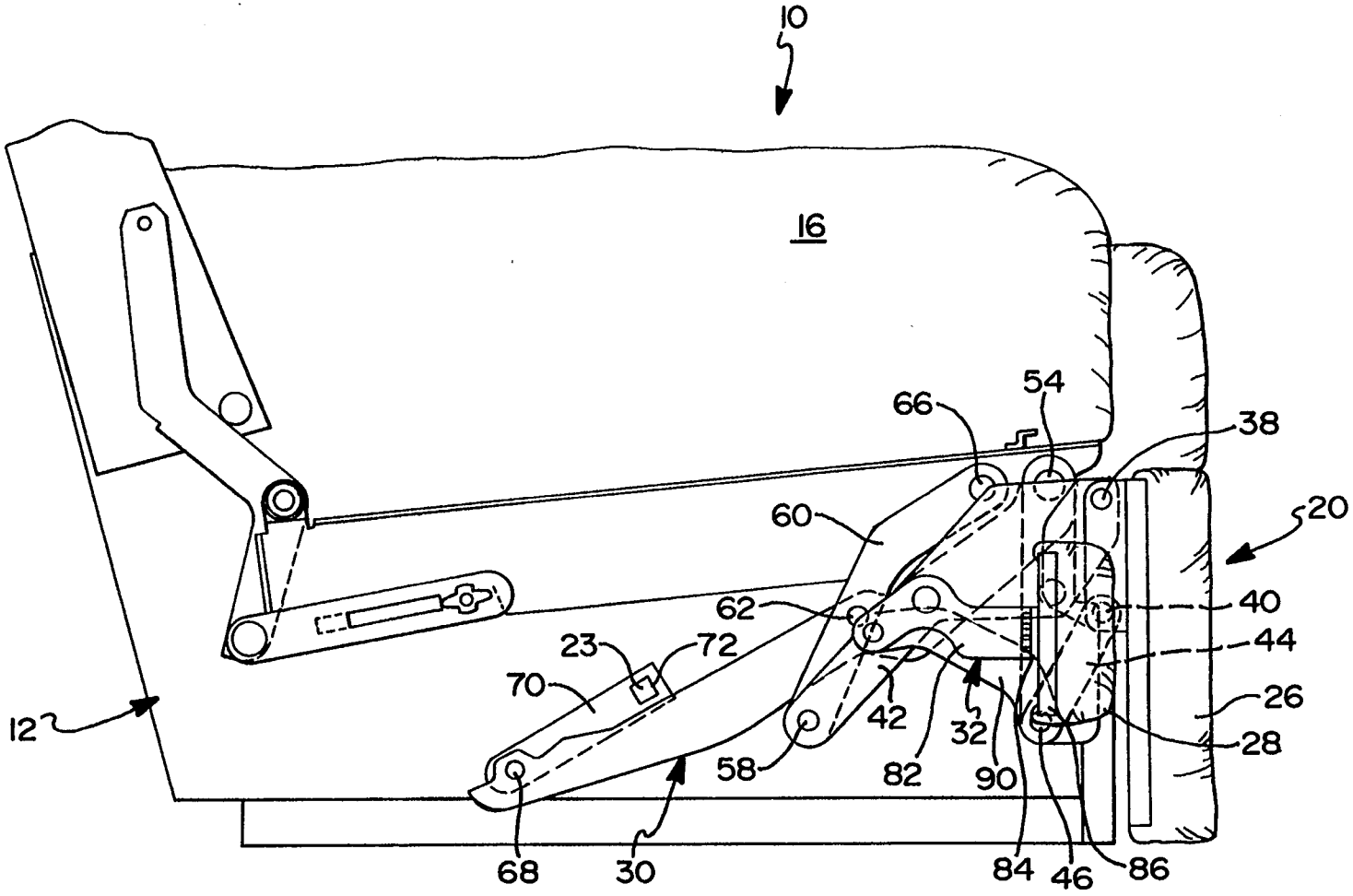
FIG. 3 is an enlarged, fragmentary elevational view of the reclining chair showing the linkage mechanism in a fully retracted condition.
Figure 4:
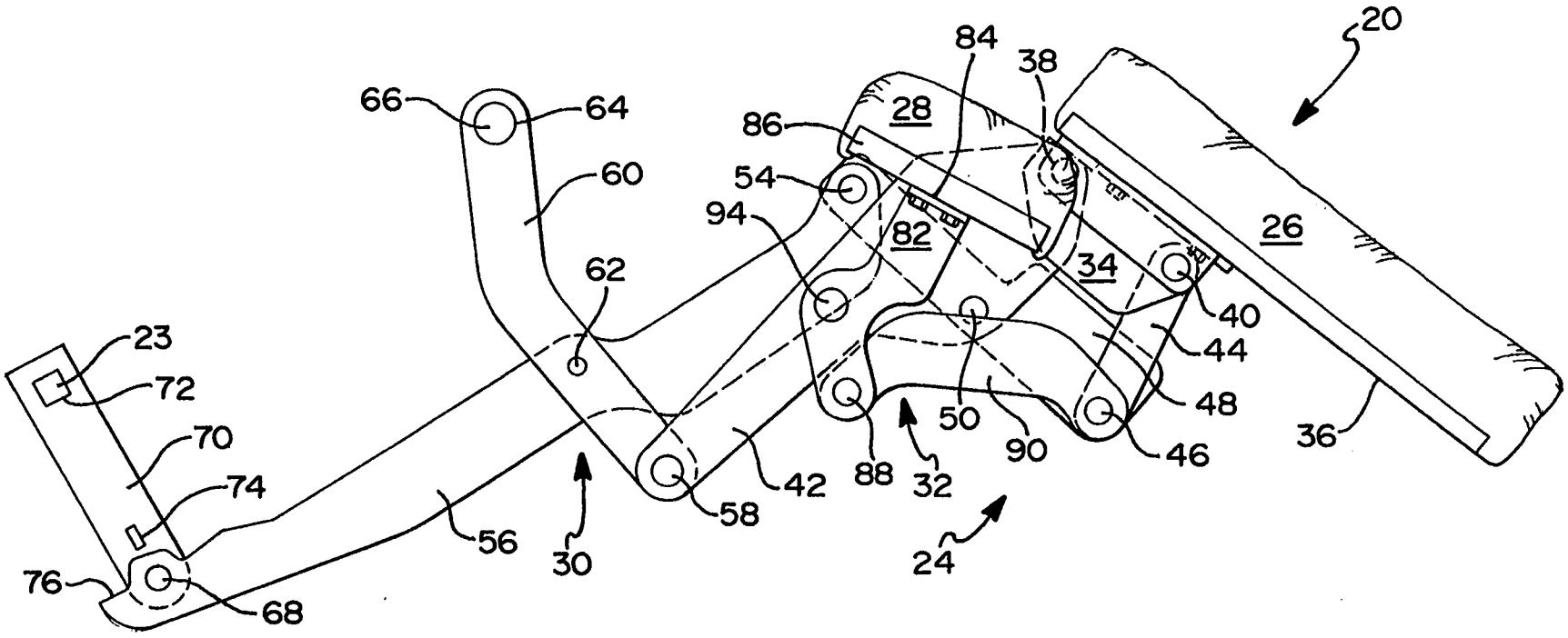
FIG. 4 is a view of the linkage mechanism in a partially extended condition.
Figure 5:
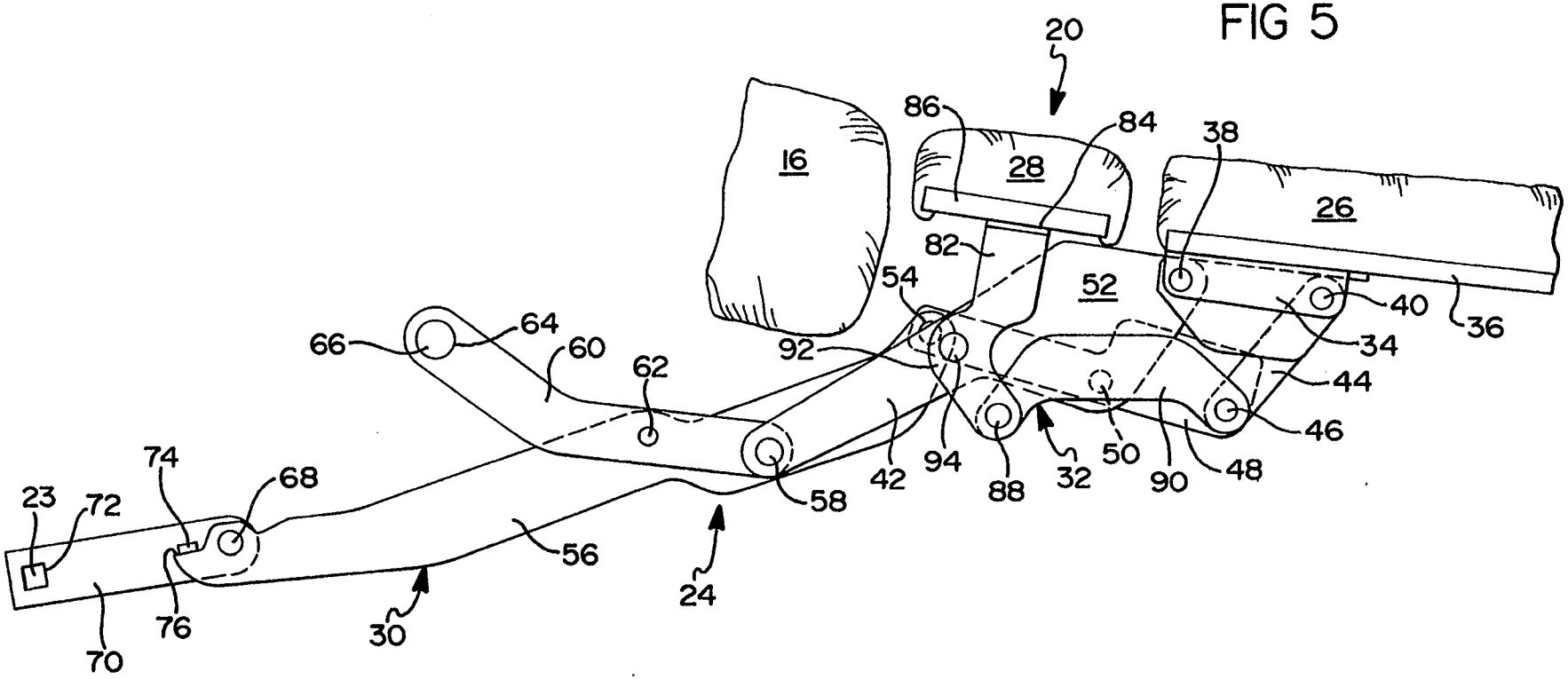
FIG. 5 illustrates the linkage mechanism in the fully extended condition.

In general, the present invention is primarily directed to the novel construction of linkage mechanisms 24. Although a more detailed description of the mechanical structure and operation of dual leg rest assembly 20 will be provided in the following paragraphs, a brief overview of its operation is warranted. Initially when an occupant of chair 10 pulls upwardly on handle 22 with a counter-clockwise rotation, the resulting rotation of drive rod 23 causes linkage mechanisms 24 to be urged forwardly toward a protracted position (FIGS. 2, 4 and 5). To stow leg rest assembly 20, the seat occupant simply pushes downwardly on handle 22 in a clockwise direction which, in turn, causes linkage mechanisms 24 to move toward a fully retracted position (FIGS. 1 and 3). Alternatively, the seat occupant may, for certain recliners, simply apply a downward force with his feet on primary leg rest panel 26 which, in turn, causes linkage mechanisms 24 to retract. Typically, a spring-biased toggle mechanism (not shown) is provided which acts on the actuation mechanism and/or linkage mechanisms 24 for assisting in fully extending and retracting linkage mechanisms 24 and, in turn, leg rest panels 26 and 28.

With particular reference now to FIGS. 3 through 5, the functional and structural aspects of the components associated with dual leg rest assembly 20 will be described with greater detail. As will be appreciated, while only one linkage mechanism 24 is shown, a substantially identical linkage mechanism is provided on the opposite lateral side of chair 10. Accordingly, each linkage mechanism 24 includes a primary linkage assembly 30 for causing extensible movement of primary leg rest panel 26 and a secondary or mid-ottoman linkage assembly 32 for causing concurrent and coordinated movement of secondary leg rest panel 28. As will be detailed, secondary linkage assembly 32 is operatively supported from primary linkage assembly 30 for articulated movement in response to movement of primary linkage assembly 30.

Primary linkage assembly 30 includes an angled bracket 34 secured via suitable fasteners to one lateral edge of a rigid frame board 36 associated with primary leg rest panel 26. As such, frame board 36 is pivotably connected at a rear pivot 38 and a front pivot 40 to one end of an elongated rear board link 42 and a shorter front board link 44, respectively, of linkage mechanism 24. The opposite end of front board link 44 is pivoted at 46 to one end of a connector link 48 which, in turn, is centrally pivoted at 50 to an enlarged segment 52 of rear board link 42. In addition, the opposite end of connector link 48 is pivoted at 54 to the top end of a long support link 56. Similarly, the opposite end of rear board link 42 is pivoted at 58 to one end of a curved swing link 60 which is pivoted at a central pivot 62 to an intermediate segment of long support link 56. The other end of curved swing link 60 is journally supported from a front support shaft 64 for rotation about a pivot 66. In the embodiment shown, support shaft 64 is non-rotatably fixed to opposite side frame portions of chair frame 12 to act as a rigid upper cross rail member. While not shown, suitable clips are also provided for maintaining the desired lateral spacing between the pair of linkage mechanisms 24 on support shaft 64.

Another connection point is pivot 68 interconnecting the curved bottom end of support link 56 and a first end of a drive link 70, the other end of which has a square hole 72 through which square drive rod 23 extends. As such, angular movement of drive rod 23 causes concurrent angular movement of drive link 70 and visa versa. Thus, selective rotation of drive rod 23 via handle 22 causes drive link 70 to rotate which acts through pivot 68 to move long support link 56. Such movement of support link 56 causes curved link 60 to swing about "fixed" pivot 66 by virtue of pivot connection 62 that curved link 60 has with long support link 56. The action of curved link 60 swinging about fixed pivot 66 acts to move rear board link 42 outwardly and upwardly. In addition, pivot 54 at the top end of long support link 56 causes connector link 48 to swing about pivot 50 such that front board link 44 is also moved outwardly and upwardly. This extensible action of primary linkage assembly 30 takes place simultaneously with both the left hand and right hand linkage mechanisms 24 when there is sufficient angular rotation of drive rod 23. In this manner, frame board 36 and primary leg panel 26 are moveable between their "stowed" vertical position and "extended" protracted position.

Drive link 70 is preferably U-shaped having parallel short and long legs joined by a base portion which overlies drive rod 23. Both legs have square aligned holes through which square drive rod 23 extends. When dual leg rest assembly 20 is protracted to its fully "extended" position, a cold deformed stop tap 74 on the long leg of drive link 70 contacts a stop shoulder 76 formed on the lower end of long support link 56 when the long leg of drive link 70 and support link 56 are almost in relatively collinear alignment. Due to engagement of stop tab 74 and stop shoulder 76, further extension of primary linkage assembly 30 is inhibited such that primary leg rest panel 26 is held in an elevated and generally horizontal position.

In addition to the above structure, each linkage mechanism 24 includes a secondary linkage assembly 32 which is supported from and interactively associated with primary linkage assembly 30 to cause articulated movement of secondary leg rest panel 28 in response to articulated movement of primary leg rest panel 26. Secondary linkage assembly 32 includes a board link 82 having an angled segment 84 adapted to be secured to one lateral edge of a rigid frame board 86 associated with secondary leg rest panel 28. The distal end of board link 82 is pivotably connected at a pivot 88 to one end of a curved connector link 90, the opposite end of which is connected at pivot 46 with front board link 44 and connector link 48. Moreover, an intermediate offset section 92 of board link 82 is pivotably connected at a pivot 94 to a central segment of rear board link 42.

As is most clearly seen from sequential review of FIGS. 3 through 5, rotation of drive rod 23 causes primary linkage assembly 30 to drive primary leg rest panel 26 between a generally vertically oriented alignment (stowed) and a generally horizontal alignment (extended). As is also shown, the front edge of seat member 16 is, in this particular embodiment, caused to move forwardly in concert with articulation of linkage mechanisms 24 to provide a predetermined relationship therebetween. Thus, in this instance, the recliner mechanism is adapted to work in coordination with the extensible movement of leg rest assembly 20. Moreover, secondary linkage assembly 32 is adapted to cause secondary leg rest panel 28 to move from a position behind and substantially parallel to primary leg rest panel 26 in the stowed position to a generally coplanar alignment relative thereto in the extended position. Moreover, secondary leg rest panel 28 pivots in an arcuate path about pivot 94 and is driven through this arcuate path due to the interconnection between board link 82 and front board link 44 via connector link 90. Due to the novel yet simplified linkage arrangement of the present invention, a desired clearance is maintained between the leg rest panels such that the thickness of upholstered leg rest panels 26 and 28 can be identical to promote more attractive styling and enhanced leg support and comfort.

An additional feature of the present invention is that several of the above-disclosed links have been configured to act as shields for inhibiting access to any pinch points during the extensible movement of linkage mechanism 24 betwen the links and/or between the leg rest panels. This feature is most clearly seen in FIGS. 3 through 5 wherein portions of angled bracket 34, enlarged segment 52 of rear board link 42 and connection link 48 are shown to overlap.

The foregoing discussion discloses and describes exemplary embodiment of the present invention. One skilled in the art will readily recognize from such discussion, and from the accompanying drawings and claims, that various changes, modifications and variations can be made therein without departing from the true spirit and fair scope of the invention as defined in the following claims.

What is claimed is:

1. In an article of furniture having a seat assembly supported from a chair frame and an actuation means for enabling a leg rest assembly to move between a stowed position and an extended position, said leg rest assembly comprising:

a primary leg rest panel;

a secondary leg rest panel; and linkage means interconnecting said primary and secondary leg rest panels to said actuation means for coordinated articulated movement such that in said stowed position said secondary leg rest panel is oriented behind and in general parallelism with said primary leg rest panel so as to be concealed thereby, and in said extended position said primary and secondary leg panels lie in substantially the same plane so as to provide a substantial continuous and uninterrupted support surface with said seat assembly, said linkage means including a first linkage for causing articulated movement of said primary leg rest panel and a second linkage for causing articulated movement of said secondary leg rest panel, and wherein said second linkage is supported on said first linkage for movement in response to movement of said first linkage;

said first linkage comprising first and second board links pivotally connected to said primary leg rest panel, a first connector link pivotally interconnecting said first board link to said chair frame, a second connector link pivotally interconnecting said second board link to one end of a support link, and a drive link interconnecting said actuation means to the opposite end of said support link, said first connector link being pivotably interconnected to an intermediate portion of said support link and said second connector link being pivotally interconnected to an intermediate portion of said first board link; and said second link comprising a third board link having a first portion on which said secondary leg rest panel is secured, a second portion pivotally interconnected to said first board link and a third portion pivotably interconnected to said second board link via a third connector link.

2. The leg rest assembly of claim 1 wherein said third board link pivots about said pivotal interconnection between its second portion and said first board link in response to pivotable movement of said third connector link.

3. The leg rest assembly of claim 2 wherein said first portion of said third board link has an angled bracket flange to which said secondary leg rest panel is secure, said second portion is an offset intermediate segment of said third panel link and said third portion is a distal end segment thereof.

4. The leg rest assembly of claim 1 wherein said primary and secondary leg rest panels are upholstered members having the same thickness.

5. An article of furniture comprising:

a seat assembly supported from a chair frame;

an actuation means for enabling a leg rest assembly to move between a stowed position and an extended position;

said leg rest assembly including a primary leg rest panel, a secondary leg rest panel, linkage means interconnecting said primary and secondary leg rest panels to said actuation means for coordinated articulated movement such that in said stowed position said secondary leg rest panel is oriented behind and in general parallelism with said primary leg rest panel so as to be concealed thereby, and in said extended position said primary and secondary leg panels lie in substantially the same plane so as to provide a substantial continuous and uninterrupted support surface with said seat assembly, said linkage means including a first linkage for causing articulated movement of said primary leg rest panel and a second linkage for causing articulated movement of said secondary leg rest panel, and wherein said second linkage is supported on said first linkage for movement in response to movement of said first linkage, said first linkage comprising first and second board links pivotally connected to said primary leg rest panel, a first connector link pivotally interconnecting said first board link to said chair frame, a second connector link pivotally interconnecting said second board link to one end of a support link, and a drive link interconnecting said actuation means to the opposite end of said support link, said first connector link being pivotably interconnected to an intermediate portion of said support link and said second connector link being pivotally interconnected to an intermediate portion of said first board link, and said second link comprising a third board link having a first portion on which said secondary leg rest panel is secured, a second portion pivotally interconnected to said first board link and a third portion pivotably interconnected to said second board link via a third connector link.

6. The article of furniture of claim 5 wherein said third board link pivots about said pivotal interconnection between its second portion and said first board link in response to pivotable movement of said third connector link.

7. The article of furniture of claim 6 wherein said first portion of said third board link has an angled bracket flange to which said secondary leg rest panel is secure, said second portion is an offset intermediate segment of said third panel link and said third portion is a distal end segment thereof.

8. The article of furniture of claim 5 wherein said primary and secondary leg rest panels are upholstered members having the same thickness.

* * * * *